US010784055B2

(12) United States Patent
Hayashida et al.

(10) Patent No.: US 10,784,055 B2
(45) Date of Patent: Sep. 22, 2020

(54) CONTACT PIECE UNIT AND RELAY

(71) Applicant: OMRON CORPORATION, Kyoto-shi, Kyoto (JP)

(72) Inventors: Kaori Hayashida, Yamaga (JP); Yuji Kozai, Kumamoto (JP)

(73) Assignee: OMRON Corporation, Kyoto-shi (JP)

( * ) Notice: Subject to any disclaimer, the term of this patent is extended or adjusted under 35 U.S.C. 154(b) by 61 days.

(21) Appl. No.: 15/754,172

(22) PCT Filed: Oct. 3, 2016

(86) PCT No.: PCT/JP2016/079256
§ 371 (c)(1),
(2) Date: Feb. 21, 2018

(87) PCT Pub. No.: WO2017/073243
PCT Pub. Date: May 4, 2017

(65) Prior Publication Data

US 2018/0358186 A1 Dec. 13, 2018

(30) Foreign Application Priority Data

Oct. 29, 2015 (JP) ..... 2015-213087

(51) Int. Cl.
*H01H 3/00* (2006.01)
*H01H 1/54* (2006.01)
(Continued)

(52) U.S. Cl.
CPC ..... *H01H 1/54* (2013.01); *H01H 9/38* (2013.01); *H01H 50/18* (2013.01);
(Continued)

(58) Field of Classification Search
CPC ..... H01H 50/18; H01H 50/56; H01H 50/58; H01H 1/50; H01H 1/54; H01H 1/64; H01H 9/38; H01H 2001/545
(Continued)

(56) References Cited

U.S. PATENT DOCUMENTS 4,328,476 A * 5/1982 Bernier ..... H01H 50/24 335/128
4,551,698 A * 11/1985 Aidn ..... H01H 51/2272 335/78
(Continued)

FOREIGN PATENT DOCUMENTS

CN 102723241 A 10/2012
CN 203839295 U 9/2014
(Continued)

OTHER PUBLICATIONS

Indian Office Action dated Jan. 29, 2020 in a counterpart Indian patent application.
(Continued)

*Primary Examiner* — Shawki S Ismail
*Assistant Examiner* — Lisa N Homza
(74) *Attorney, Agent, or Firm* — Metrolex IP Law Group, PLLC

(57) ABSTRACT

A contact piece unit includes a terminal, a contact piece, and a contact. The contact piece is connected with the terminal, and disposed at a position facing the terminal. The contact is attached to the contact piece. The terminal includes a connection portion, a body, and a narrow portion. The connection portion is connected with the contact piece. The body extends in a lengthwise direction of the contact piece from the connection portion. The narrow portion has a width smaller than a width of the body and smaller than a width of the contact piece.

11 Claims, 11 Drawing Sheets

(51) Int. Cl.

| | |
|---|---|
| ***H01H 50/56*** | (2006.01) |
| ***H01H 9/38*** | (2006.01) |
| ***H01H 50/64*** | (2006.01) |
| ***H01H 50/58*** | (2006.01) |
| ***H01H 51/22*** | (2006.01) |
| ***H01H 50/18*** | (2006.01) |
| ***H01H 50/54*** | (2006.01) |

(52) U.S. Cl.
CPC ..... *H01H 50/541* (2013.01); *H01H 50/56* (2013.01); *H01H 50/58* (2013.01); *H01H 50/64* (2013.01); *H01H 50/641* (2013.01); *H01H 51/2227* (2013.01)

(58) Field of Classification Search
USPC ..... 335/195
See application file for complete search history.

(56) References Cited

U.S. PATENT DOCUMENTS

| | | | | |
|---|---|---|---|---|
| 4,571,566 | A * | 2/1986 | Saur | H01H 51/2281 335/78 |
| 4,703,293 | A * | 10/1987 | Ono | H01H 51/229 335/80 |
| 4,731,597 | A * | 3/1988 | Hinrichs | H01H 50/026 335/128 |
| 4,743,877 | A | 5/1988 | Oberndorfer et al. | |
| 5,117,209 | A * | 5/1992 | Sato | H01H 50/026 335/80 |
| 5,357,230 | A * | 10/1994 | Mikawa | H01H 51/2281 335/128 |
| 5,617,066 | A * | 4/1997 | Dittmann | H01H 51/2281 335/78 |
| 5,910,759 | A | 6/1999 | Passow | |
| 6,020,801 | A | 2/2000 | Passow | |
| 6,046,661 | A | 4/2000 | Reger et al. | |
| 6,292,075 | B1 | 9/2001 | Connell et al. | |
| 6,320,485 | B1 | 11/2001 | Gruner | |
| 6,426,689 | B1 | 7/2002 | Nakagawa et al. | |
| 6,661,319 | B2 | 12/2003 | Schmelz | |
| 6,788,176 | B2 | 9/2004 | Schmelz | |
| 6,911,884 | B2 * | 6/2005 | Uotome | H01H 47/06 335/132 |
| 6,924,719 | B2 * | 8/2005 | Saruwatari | H01H 50/08 335/17 |
| 6,940,375 | B2 | 9/2005 | Sanada et al. | |
| 6,949,997 | B2 | 9/2005 | Bergh et al. | |
| 7,659,800 | B2 | 2/2010 | Gruner et al. | |
| 7,859,370 | B2 * | 12/2010 | Shirakawa | G02B 6/3564 200/181 |
| 7,982,562 | B2 | 7/2011 | Yang et al. | |
| 8,330,564 | B2 | 12/2012 | Miller | |
| 9,484,172 | B2 * | 11/2016 | Connell | H01H 1/54 |
| 9,548,173 | B2 * | 1/2017 | Connell | H01H 50/16 |
| 9,741,518 | B2 | 8/2017 | Choi | |
| 9,899,174 | B2 | 2/2018 | Zhang et al. | |
| 10,541,097 | B2 | 1/2020 | Hoffmann | |
| 2002/0135446 | A1 | 9/2002 | Takano et al. | |
| 2009/0033446 | A1 | 2/2009 | Gruner et al. | |
| 2014/0225688 | A1 | 8/2014 | Masui et al. | |
| 2015/0002248 | A1 | 1/2015 | Iwamoto | |
| 2015/0042423 | A1 * | 2/2015 | Hoffmann | H01H 50/541 335/133 |
| 2015/0325398 | A1 | 11/2015 | Nakahara et al. | |
| 2016/0012997 | A1 | 1/2016 | Neuhaus et al. | |
| 2018/0240631 | A1 * | 8/2018 | Hayashida | H01H 50/56 |
| 2018/0269018 | A1 * | 9/2018 | Shimoda | H01H 50/56 |
| 2019/0013172 | A1 * | 1/2019 | Hayashida | H01H 50/64 |

FOREIGN PATENT DOCUMENTS

| | | | |
|---|---|---|---|
| CN | 104282493 | A | 1/2015 |
| CN | 104508787 | A | 4/2015 |
| CN | 204464182 | U | 7/2015 |
| CN | 204596721 | U | 8/2015 |
| CN | 104969325 | A | 10/2015 |
| EP | 1511052 | B1 | 11/2007 |
| EP | 2782110 | A1 | 9/2014 |
| EP | 2822011 | A1 | 1/2015 |
| EP | 2394284 | B1 | 4/2016 |
| EP | 3021342 | A1 | 5/2016 |
| EP | 3089190 | A1 | 11/2016 |
| EP | 3113204 | A1 | 1/2017 |
| JP | S32-7501 | Y1 | 7/1957 |
| JP | S56-100819 | U | 8/1981 |
| JP | S58-71918 | U | 5/1983 |
| JP | S58-182321 | U | 12/1983 |
| JP | S59-111219 | A | 6/1984 |
| JP | S59-126443 | U | 8/1984 |
| JP | 2005-183097 | A | 7/2005 |
| JP | 2009-224150 | A | 10/2009 |
| JP | 2012-517092 | A | 7/2012 |
| JP | 2012-212667 | A | 11/2012 |
| JP | 2013-41764 | A | 2/2013 |
| JP | 5741679 | B1 | 7/2015 |
| JP | 2015-159025 | A | 9/2015 |
| JP | 2015-216053 | A | 12/2015 |
| WO | 2015/005082 | A1 | 1/2015 |
| WO | 2015/005313 | A1 | 1/2015 |
| WO | 2015/045738 | A1 | 4/2015 |
| WO | 2015/098171 | A1 | 7/2015 |
| WO | 2015/125319 | A1 | 8/2015 |

OTHER PUBLICATIONS

Chinese Office Action (CNOA) dated Dec. 5, 2018 in a related Chinese patent application.
Chinese Office Action (CNOA) dated Sep. 29, 2018 in a counterpart Chinese patent application.
Chinese Office Action (CNOA) dated Jun. 11, 2019 in a related Chinese patent application.
Indian Office Action dated Dec. 9, 2019 in a related Indian patent application.
Chinese Office Action (CNOA) dated Nov. 19, 2018 in a related Chinese patent application.
German Office Action dated Oct. 23, 2019 in a counterpart German patent application.
English translation of the International Search Report of PCT/JP2016/079256 dated Nov. 8, 2016.
English translation of the Written Opinion of PCT/JP2016/079256 dated Nov. 8, 2016.
English translation of the International Search Report of PCT/JP2016/079237 dated Nov. 22, 2016.
English translation of the Written Opinion of PCT/JP2016/079237 dated Nov. 22, 2016.
English translation of the International Search Report of PCT/JP2016/079269 dated Nov. 22, 2016.
English translation of the Written Opinion of PCT/JP2016/079269 dated Nov. 22, 2016.
U.S. Office Action dated Feb. 28, 2020 in a related U.S. Appl. No. 15/754,056.

* cited by examiner

CONTACT PIECE UNIT AND RELAY

TECHNICAL FIELD

The present invention relates to a contact piece unit and a relay.

BACKGROUND ART

There is known a contact piece unit incorporated in a relay, and including a terminal and a contact piece connected to the terminal. For example, a relay disclosed in Patent Document 1 includes a contact piece extending in a lengthwise direction of a terminal, and disposed at a position facing the terminal. A proximal end portion of the contact piece is connected with a proximal end portion of the terminal. A leading end portion of the contact piece is disposed with a space left from the terminal. A movable contact is attached to the contact piece.

A link member is attached to the leading end portion of the contact piece. The link member is driven by a coil unit to press the contact piece. The pressed contact piece elastically deforms, whereby the movable contact moves toward a fixed contact. The movable contact thus comes into contact with the fixed contact. As a result, conduction is achieved between a terminal connected with the movable contact and a terminal connected with the fixed contact.

PRIOR ART DOCUMENT

Patent Document

Patent Document 1: U.S. Pat. No. 7,659,800

SUMMARY OF THE INVENTION

Problems to be Solved by the Invention

According to the contact piece unit described above, the contact piece and the terminal face each other. In this case, current i flows in a contact piece 101 and a terminal 102 in opposite directions. Accordingly, electromagnetic repulsion force F acts on the contact piece 101 in a direction away from the terminal 102 as illustrated in FIG. 11. The electromagnetic repulsion force F acts in such a direction as to press a movable contact 103 toward a fixed contact 104. The contact piece unit described above is therefore capable of improving stability of contact between the contacts 103 and 104 by generating the electromagnetic repulsion force F in the contact piece 101 and utilizing the electromagnetic repulsion force F as assisting force for assisting contact force between the contacts 103 and 104 at the time of overcurrent.

Electromagnetic repulsion force increases in accordance with increase in current density. Accordingly, it is preferable to increase current density of current flowing in a terminal to raise strength of assisting force. However, high current density produces a problem of a temperature rise in the terminal.

An object of the present invention is to provide a contact piece unit and a relay capable of improving assisting force produced by electromagnetic repulsion force for assisting contacts while suppressing a temperature rise of a terminal.

Means for Solving the Problem

A contact piece unit according to an aspect of the present invention includes a terminal, a contact piece, and a contact.

The contact piece is connected with the terminal, and disposed at a position facing the terminal. The contact is attached to the contact piece. The terminal includes a connection portion, a body, and a narrow portion. The connection portion is connected with the contact piece. The body extends in a lengthwise direction of the contact piece from the connection portion. The narrow portion has a width smaller than a width of the body and smaller than a width of the contact piece.

In the contact piece unit according to the aspect, the width of the narrow portion is smaller than the width of the body and smaller than the width of the contact piece. In this case, the current density can be increased in the narrow portion. Accordingly, assisting force produced by electromagnetic repulsion force for assisting the contact can be improved. Moreover, the width of the terminal is partially reduced at the narrow portion. Accordingly, a temperature rise of the terminal can be suppressed, compared to the case that the entire width of the terminal is reduced.

The narrow portion may overlap with the contact as viewed in a direction perpendicular to a surface of the narrow portion. In this case, electromagnetic repulsion force generated in the narrow portion can effectively act on the contact as assisting force.

The contact piece may include a contact attaching portion to which the contact is attached. The narrow portion may overlap with a portion of the contact piece on a side where the connection portion is disposed with respect to the contact attaching portion as viewed in the direction perpendicular to the surface of the narrow portion. In this case, large electromagnetic repulsion force is generated in the portion of the contact piece on side where the connection portion is disposed with respect to the contact attaching portion, and accordingly, assisting force can be improved.

The terminal may include a recess recessed in a widthwise direction. The recess may overlap with a portion of the contact piece on a leading end side with respect to the contact. In this case, a link member provided to operate the contact piece is allowed to be positioned via the recess.

The narrow portion may be located between the body and the recess in the lengthwise direction of the terminal.

A length of the narrow portion may be smaller than a length of the recess in the lengthwise direction of the terminal. In this case, a temperature rise of the terminal can be suppressed, compared to the case that the narrow portion is excessively long.

The terminal may further include a projection that projects widthwise on a side opposite to the recess. The projection thus provided secures a sufficient width of the terminal in a portion including the recess. Accordingly, a temperature rise of the terminal can be suppressed.

The contact may include a first contact and a second contact. A height of the second contact from the contact piece may be smaller than a height of the first contact from the contact piece. The contact piece may include a first plate and a second plate. The first contact may be attached to the first plate. The second plate may be divided from the first plate by a slit that extends in the lengthwise direction of the contact piece. The second contact may be attached to the second plate. The narrow portion may overlap with the first plate as viewed in the direction perpendicular to the surface of the narrow portion.

In this case, the height of the second contact is smaller than the height of the first contact. Accordingly, at the time of contact between the contacts, the first contact comes into contact with a paired contact prior to contact of the second contact. In addition, at the time of separation between the contacts, the first contact separates from the paired contact after separation of the second contact. Accordingly, a load produced at the time of contact between the contacts or separation between the contacts is chiefly applied to the first contact. The narrow portion is therefore overlapped with the first plate to allow electromagnetic repulsion force generated in the narrow portion to effectively act on the first contact as assisting force. Accordingly, contact stability of the contact can be improved.

The narrow portion may be so disposed as not to overlap with the second plate as viewed in the direction perpendicular to the surface of the narrow portion. This configuration reduces the width of the narrow portion, thereby improving the assisting force.

The width of the narrow portion may be equal to or larger than the width of the first plate. In this case, electromagnetic repulsion force generated in the narrow portion can effectively act on the first contact as assisting force. Accordingly, contact stability of the contact can be improved.

The length of the narrow portion may be smaller than a dimension of the first contact in the lengthwise direction of the terminal. In this case, a temperature rise of the terminal can be suppressed, compared to the case that the narrow portion is excessively long.

A relay according to a second aspect of the present invention includes the contact piece unit described above. The relay according to the aspect can improve assisting force generated by electromagnetic repulsion force for assisting the contact, similarly to the contact piece unit described above. In addition, a temperature rise of the terminal can be suppressed.

Effect of the Invention

According to the present invention, a contact piece unit and a relay capable of improving assisting force produced by electromagnetic repulsion force for assisting a contact while suppressing a temperature rise of a terminal.

MODE FOR CARRYING OUT THE INVENTION

Figure 1:
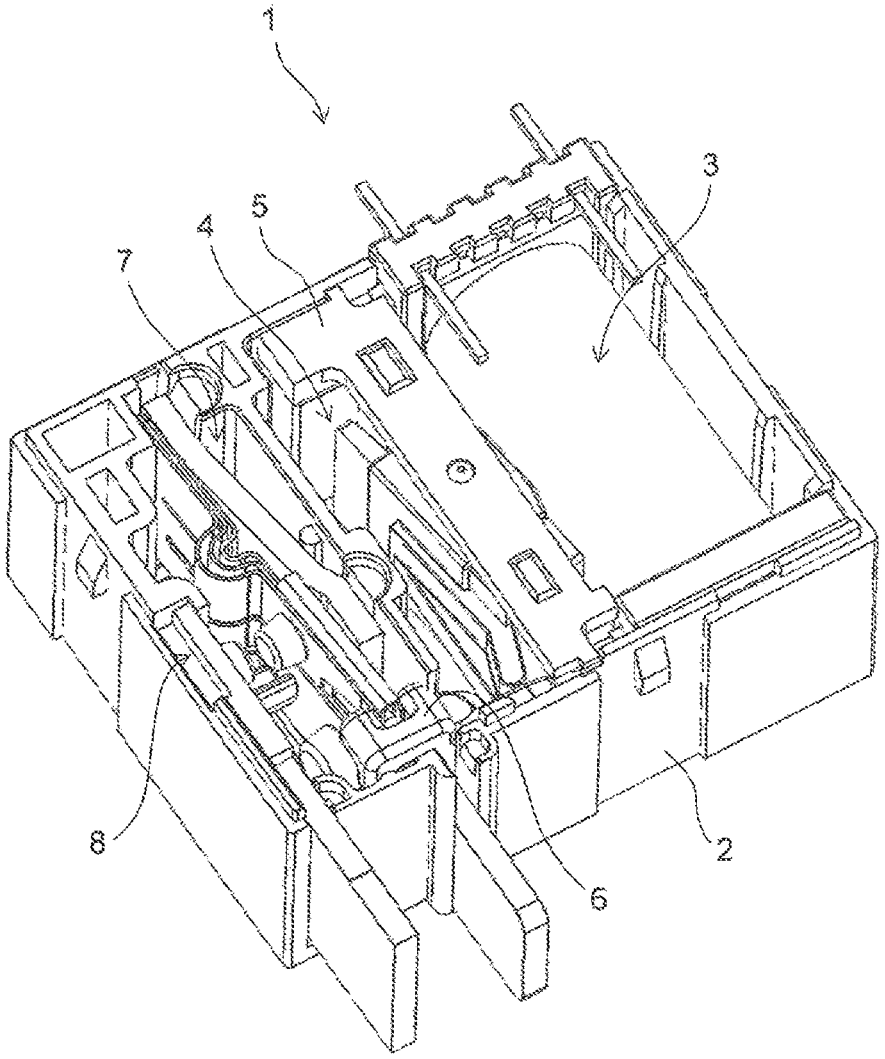
FIG. 1 is a perspective view of a relay according to an embodiment.
Figure 2:
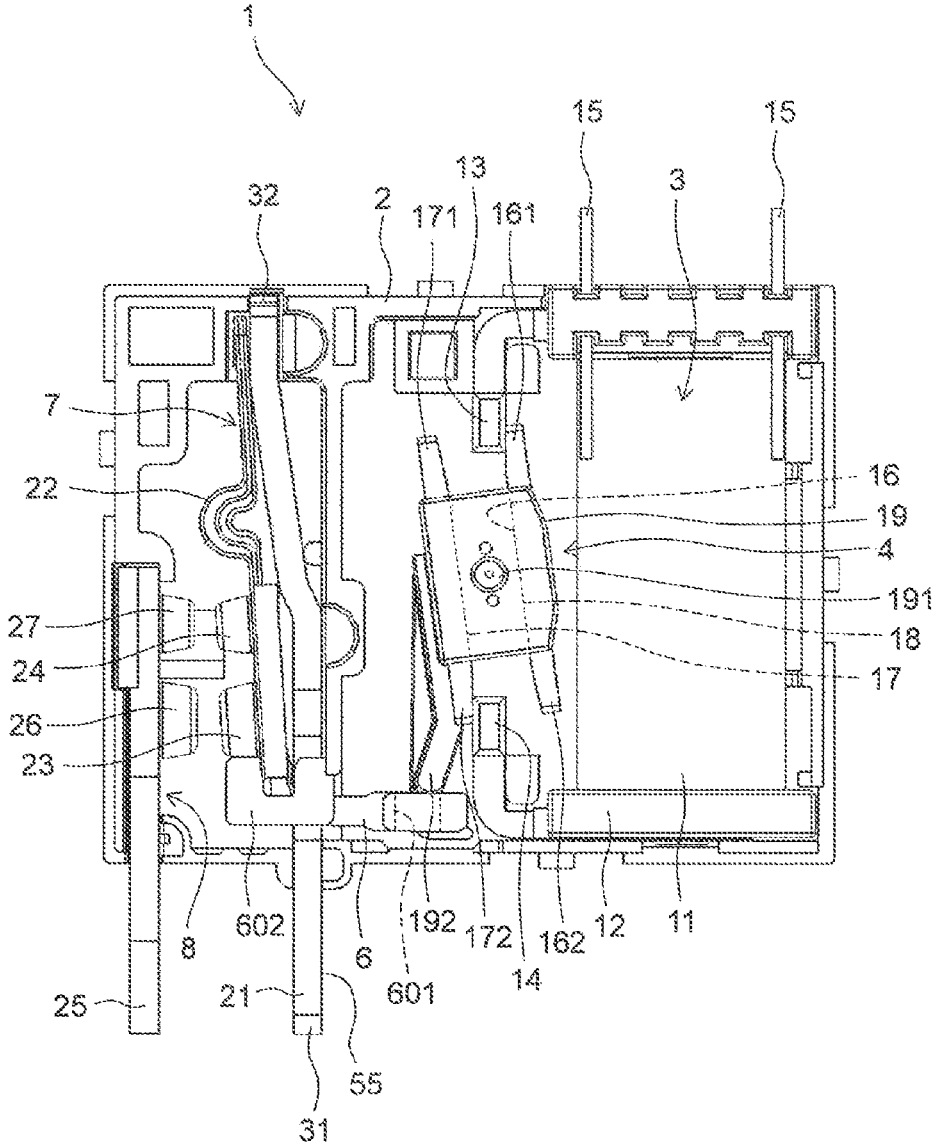
FIG. 2 is a plan view of the relay in a reset state.
Figure 3:
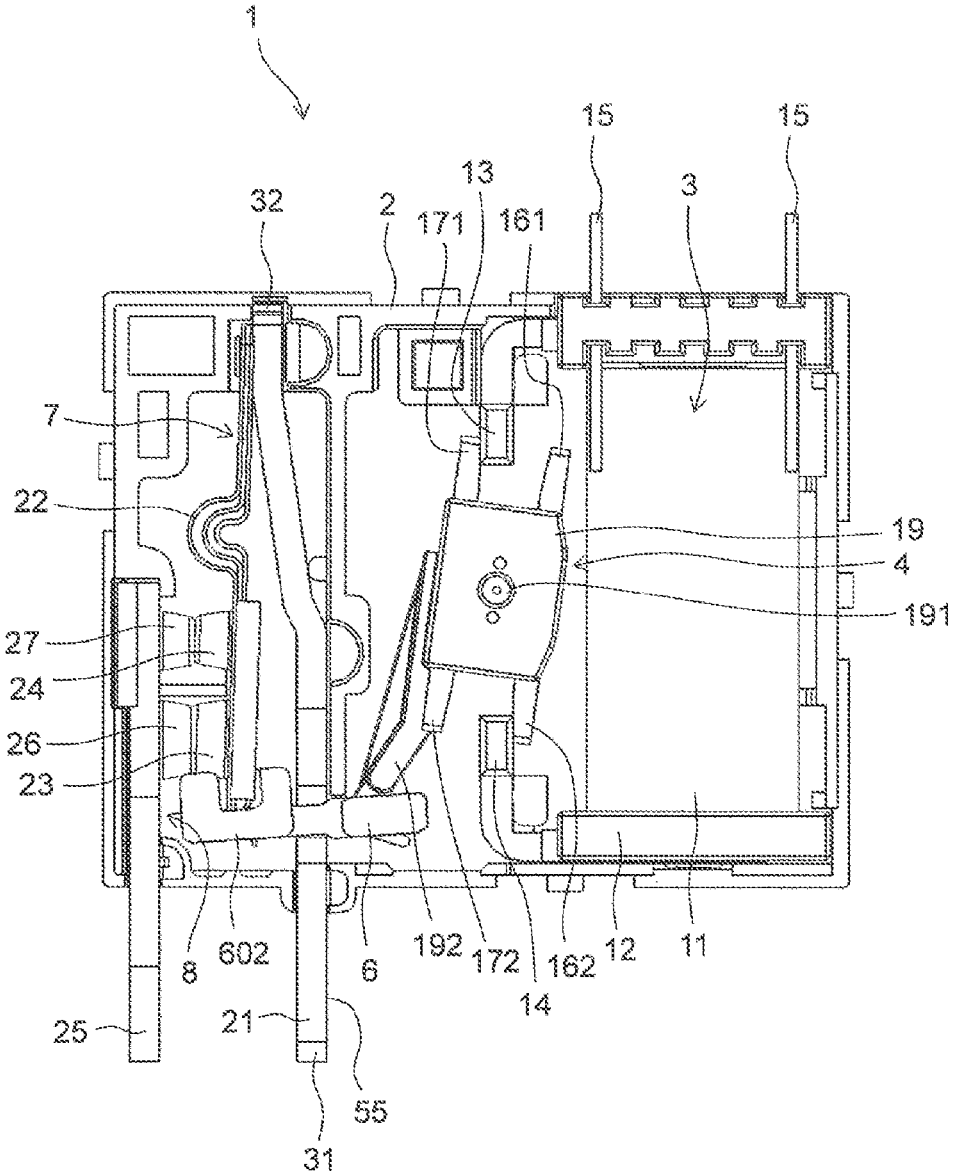
FIG. 3 is a plan view of the relay in a set state.

A relay according to an embodiment is hereinafter described with reference to the drawings. FIG. 1 is a perspective view of a relay 1 according to the embodiment. FIG. 2 is a plan view of the relay 1 in a reset state. FIG. 3 is a plan view of the relay 1 in a set state. The relay 1 includes a base 2, a driving unit 3, a movable unit 4, a support member 5, a link member 6, a contact piece unit 7, and a fixed contact terminal unit 8. The support member 5 is not shown in FIGS. 2 and 3.

The base 2 houses the driving unit 3, the movable unit 4, the link member 6, the contact piece unit 7, and the fixed contact terminal unit 8. A not-shown cover member is attached to the base 2.

The driving unit 3 drives the movable unit 4. The driving unit 3 generates electromagnetic force for rotating the movable unit 4. As illustrated in FIG. 2, the driving unit 3 includes a coil 11, a spool 12, a first yoke 13, and a second yoke 14. The coil 11 is wound around the spool 12. A coil terminal 15 is attached to the coil 11 such that the coil 11 can be energized via the coil terminal 15. A not-shown iron core is inserted into the spool 12. The first yoke 13 is connected with one end of the iron core, while the second yoke 14 is connected with the other end of the iron core.

The movable unit 4 is rotatably supported relative to the base 2. The movable unit 4 is disposed between the first yoke 13 and the second yoke 14. The movable unit 4 includes a first armature 16, a second armature 17, a permanent magnet 18, and a movable body 19. The first armature 16, the second armature 17, and the permanent magnet 18 are attached to the movable body 19. The movable body 19 is rotatably supported on the base 2 around a rotation shaft 191. The movable body 19 includes an arm 192. The arm 192 extends toward the link member 6.

The first armature 16 includes a first end 161 and a second end 162. The second armature 17 includes a third end 171 and a fourth end 172. The first end 161 and the third end 171 project in the same direction from the movable body 19. The second end 162 and the fourth end 172 project in the direction opposite to the projection direction of the first end 161 and the third end 171 from the movable body 19.

The link member 6 connects the movable body 19 and the contact piece unit 7. The link member 6 is so disposed as to cross a first terminal 21 of the contact piece unit 7 described below in plan view. One end of the link member 6 is connected with the movable body 19. The other end of the link member 6 is connected with the contact piece unit 7. More specifically, the link member 6 includes a connection hole 601. A leading end of the arm 192 of the movable body 19 is disposed in the connection hole 601. This configuration latches the arm 192 to the link member 6 during driving of the link member 6 by the movable body 19. The link member 6 further includes a pressing portion 602. The pressing portion 602 is so disposed as to surround a leading end of a contact piece 22 of the contact piece unit 7 described below. This configuration latches the pressing portion 602 to the leading end of the contact piece 22 during driving of the link member 6 by the movable body 19.

The contact piece unit 7 includes a first terminal 21, the contact piece 22, and movable contacts 23 and 24. The contact piece 22 is connected with the first terminal 21. The contact piece 22 is disposed at a position facing the first terminal 21. The movable contacts 23 and 24 are attached to the contact piece 22. The contact piece unit 7 will be detailed below.

The fixed contact terminal unit 8 includes a second terminal 25 and fixed contacts 26 and 27. The fixed contacts 26 and 27 are attached to the second terminal 25. The fixed contacts 26 and 27 are disposed at positions facing the movable contacts 23 and 24, respectively.

Next, an operation of the relay 1 is described. In the reset state illustrated in FIG. 2, the first end 161 of the first armature 16 contacts the first yoke 13, while the second end 162 separates from the second yoke 14. The fourth end 172 of the second armature 17 contacts the second yoke 14, while the third end 171 separates from the first yoke 13. The movable contacts 23 and 24 separate from the fixed contacts 26 and 27, respectively.

When the coil 11 is energized in a predetermined direction, electromagnetic force is generated to rotate the movable unit 4 in a predetermined forward direction (clockwise in FIG. 2). The movable unit 4 therefore rotates in the forward direction. The link member 6 moves in the left direction in FIG. 2 in accordance with rotation of the movable unit 4 in the forward direction. In this case, a leading end of the contact piece 22 moves in the left direction in FIG. 2, and accordingly, the movable contacts 23 and 24 move toward the fixed contacts 26 and 27. The movable contacts 23 and 24 therefore come into contact with the fixed contacts 26 and 27. As a result, the reset state of the relay 1 illustrated in FIG. 2 is switched to the set state illustrated in FIG. 3.

In the set state, the first end 161 of the first armature 16 separates from the first yoke 13, while the second end 162 contacts the second yoke 14 as illustrated in FIG. 3. In addition, the fourth end 172 of the second armature 17 separates from the second yoke 14, while the third end 171 contacts the first yoke 13. The set state is maintained by magnetic force of the permanent magnet 18 even at a stop of energization of the coil 11 in this state.

When the coil 11 is subsequently energized in the direction opposite to the foregoing predetermined direction, electromagnetic force is generated to rotate the movable unit 4 in the direction opposite to the foregoing forward direction (anticlockwise in FIG. 3). As a result, the movable unit 4 rotates in the opposite direction. The link member 6 moves in the right direction in FIG. 3 in accordance with the rotation of the movable unit 4 in the opposite direction. In this case, the leading end of the contact piece unit 7 moves in the right direction in FIG. 3, and accordingly, the movable contacts 23 and 24 move away from the fixed contacts 26 and 27, respectively. The movable contacts 23 and 24 therefore separate from the fixed contacts 26 and 27, respectively. As a result, the set state of the relay 1 illustrated in FIG. 3 is switched to the reset state illustrated in FIG. 2. The reset state is maintained by magnetic force of the permanent magnet 18 even at a stop of energization of the coil 11 in this state.

Figure 4:
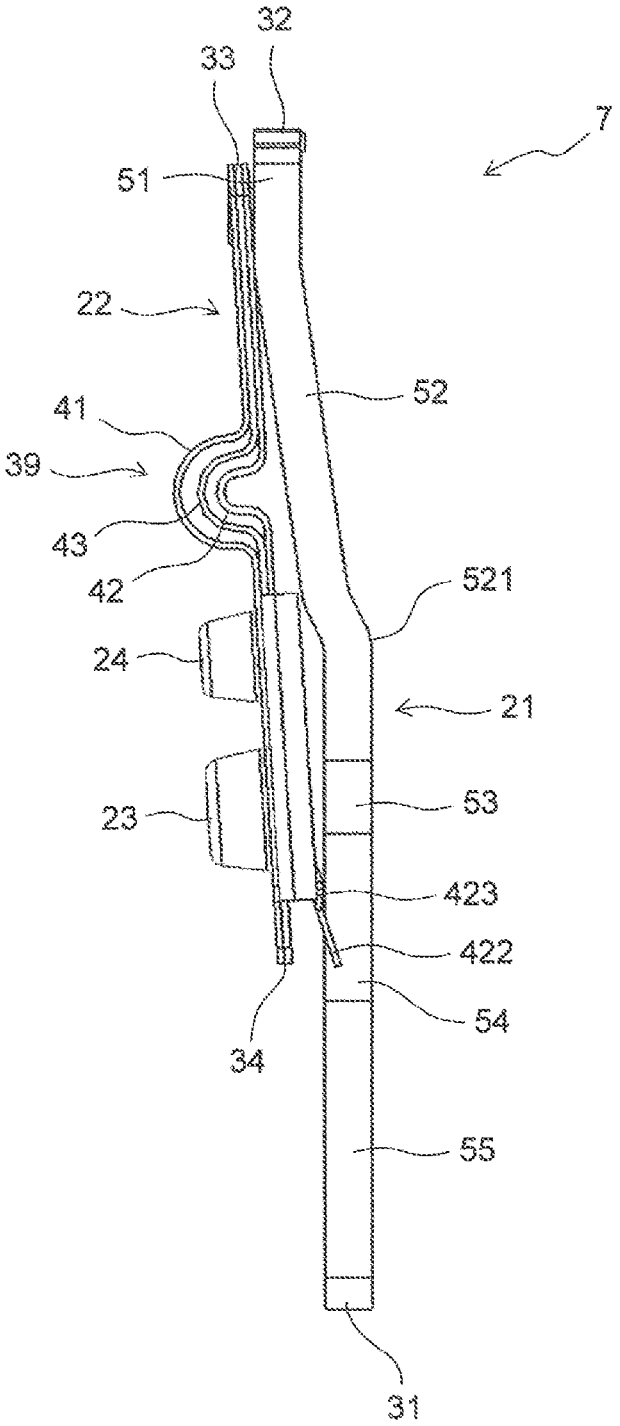
FIG. 4 is a plan view of a contact piece unit according to the embodiment.
Figure 5:
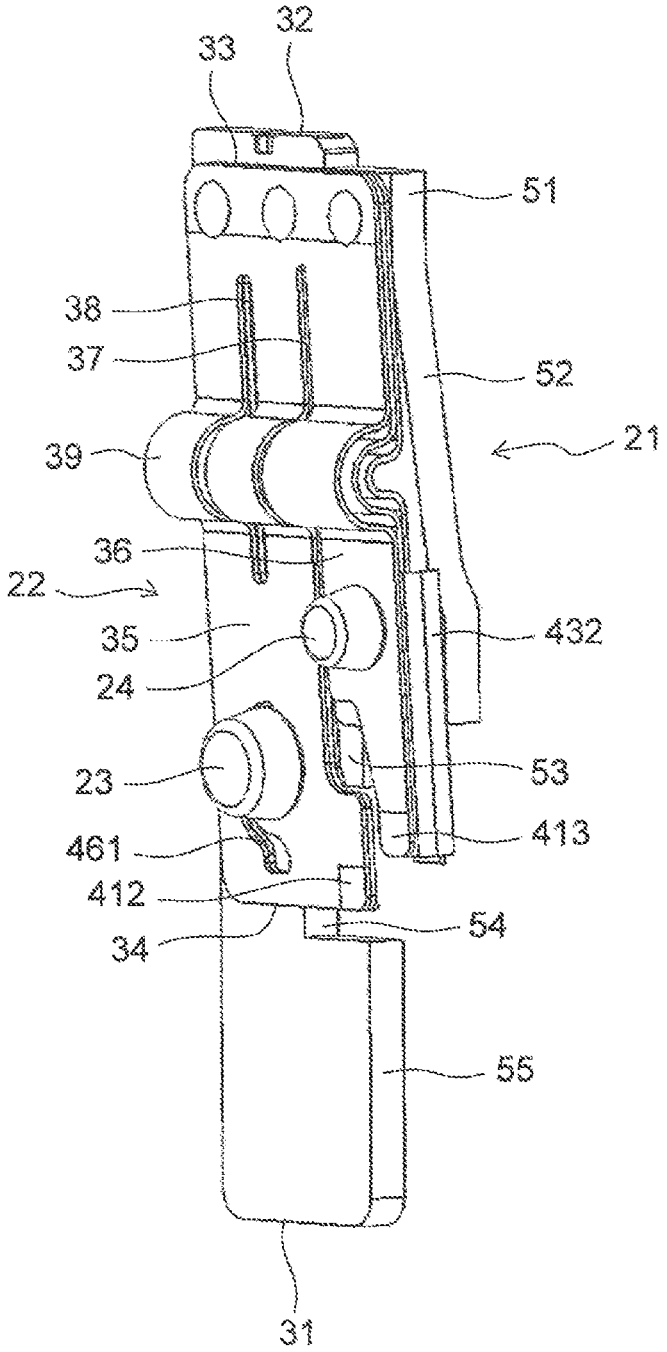
FIG. 5 is a perspective view of the contact piece unit.
Figure 6:
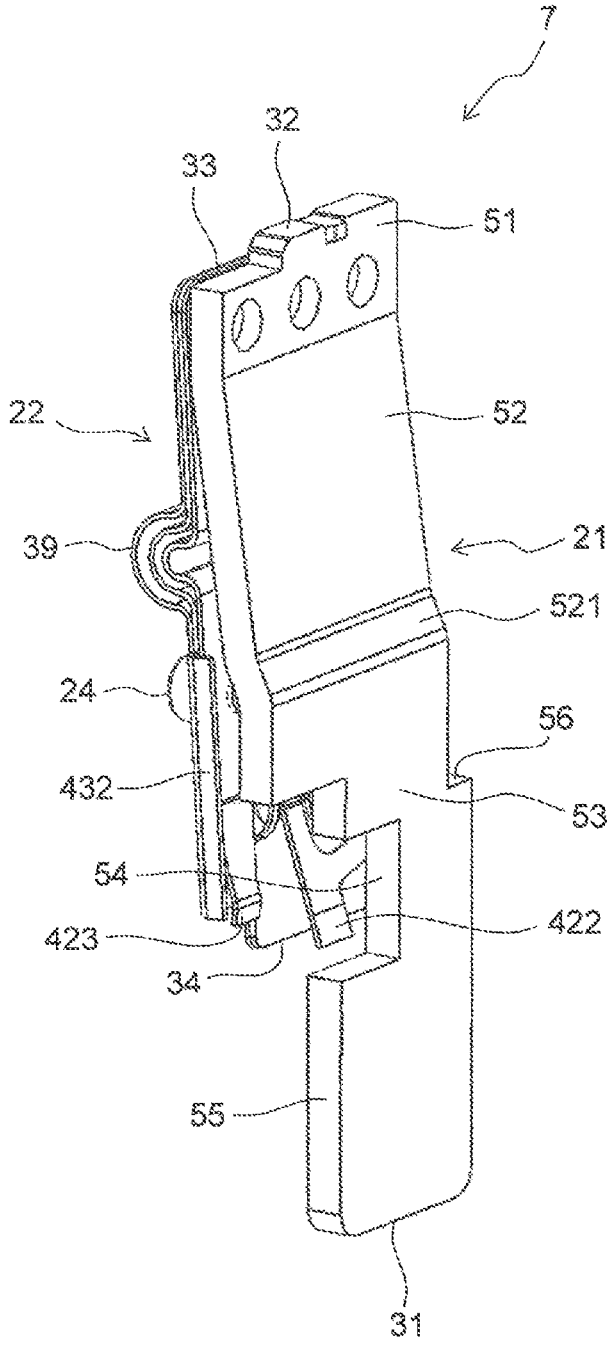
FIG. 6 is a perspective view of the contact piece unit.
Figure 7:
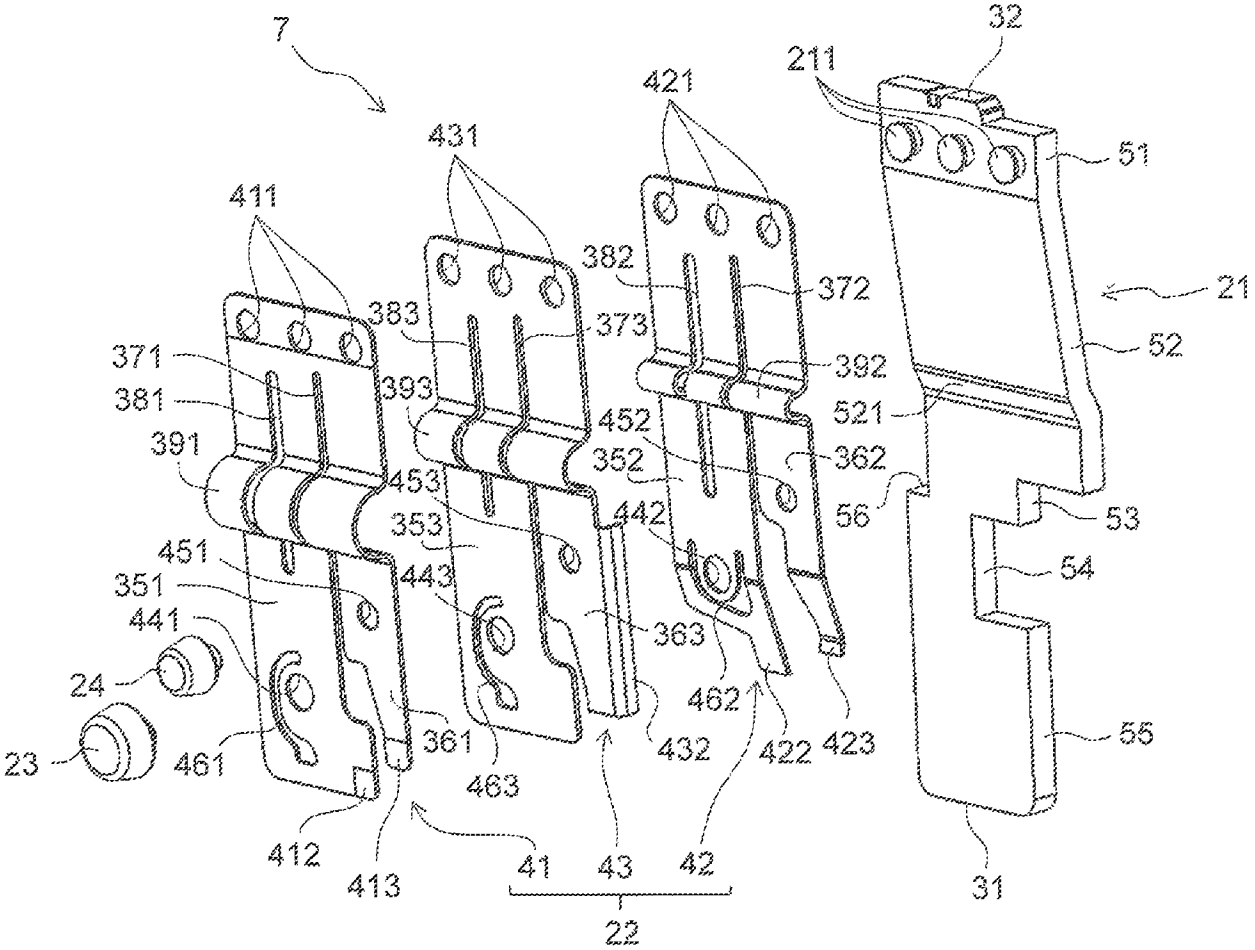
FIG. 7 is an exploded perspective view of the contact piece unit.
Figure 8:
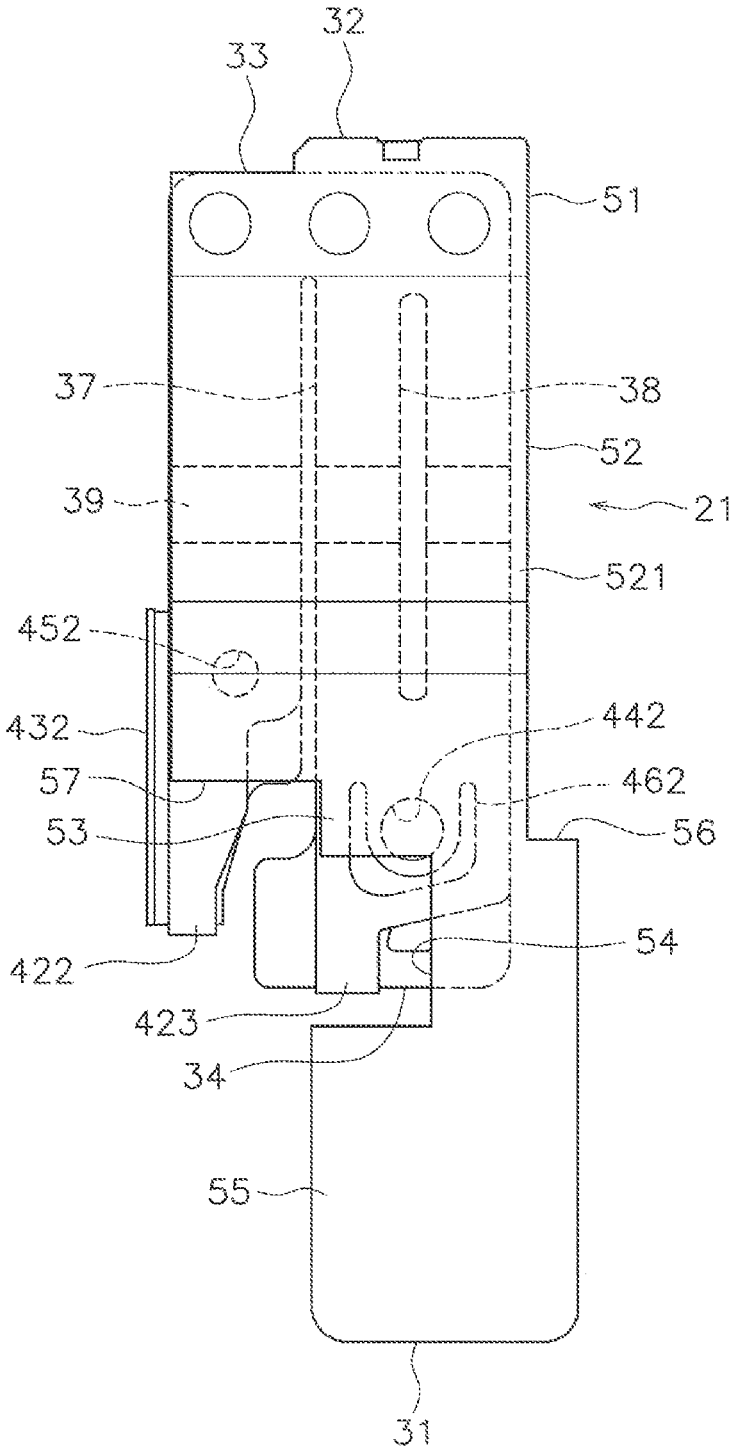
FIG. 8 is a side view of the contact piece unit.
Figure 9:
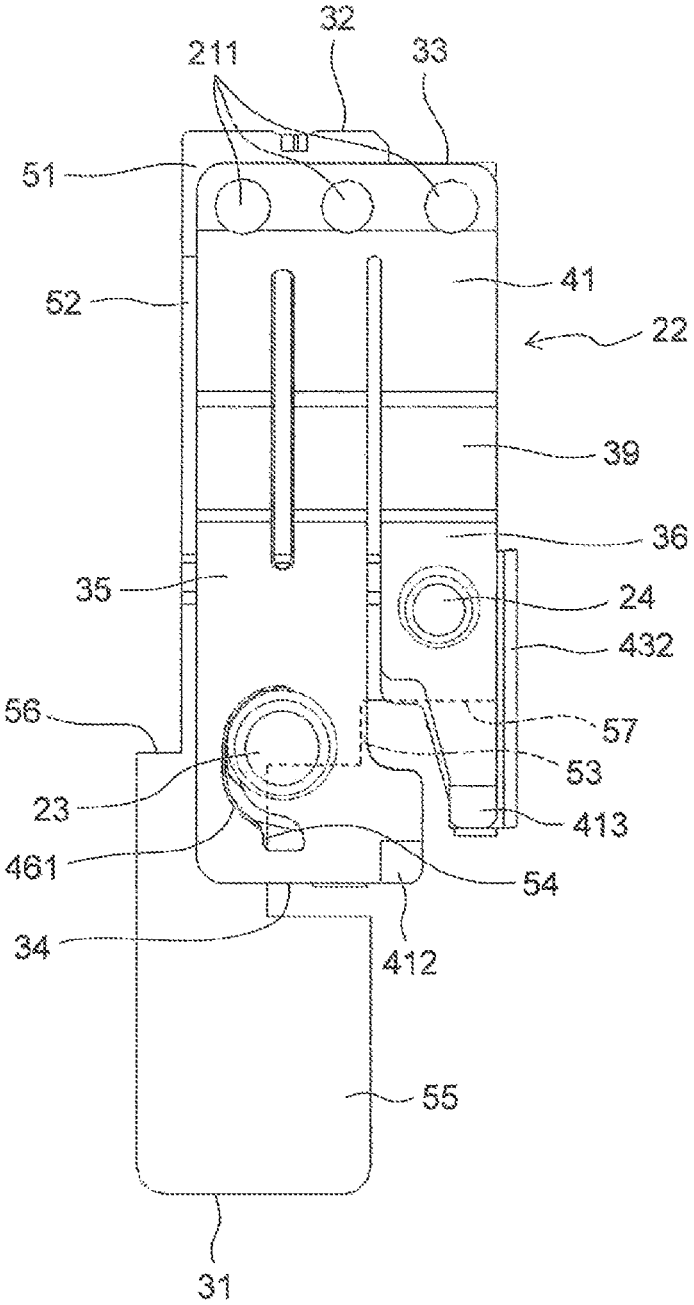
FIG. 9 is a side view of the contact piece unit.

The contact piece unit 7 according to the embodiment is now described. FIG. 4 is a plan view of the contact piece unit 7. FIGS. 5 and 6 are perspective views of the contact piece unit 7. FIG. 7 is an exploded perspective view of the contact piece unit 7. FIG. 8 is a side view of the contact piece unit 7 as viewed from the first terminal 21 side. FIG. 9 is a side view of the contact piece unit 7 as viewed from the contact piece 22 side.

As illustrated in FIGS. 4 to 7, the first terminal 21 has an elongate plate shape. The first terminal 21 has a leading end portion 31 and a proximal end portion 32. As illustrated in FIG. 2, the leading end portion 31 of the first terminal 21 is so disposed as to project from the base 2 to the outside. The proximal end portion 32 of the first terminal 21 is disposed inside the base 2.

According to the embodiment, a direction in parallel to a direction extending from the proximal end portion 32 toward the leading end portion 31 is referred to as a lengthwise direction. The lengthwise direction corresponds to an up-down direction in FIG. 4. A direction perpendicular to the lengthwise direction and a plate thickness direction of the first terminal 21 is referred to as a widthwise direction. The plate thickness direction of the first terminal 21 corresponds to a right-left direction in FIG. 4. The widthwise direction is a direction perpendicular to the sheet of FIG. 4, and corresponds to a right-left direction in FIGS. 8 and 9.

The movable contacts 23 and 24 include the first movable contact 23 and the second movable contact 24, respectively. A height of the second movable contact 24 from the contact piece 22 is smaller than a height of the first movable contact 23 from the contact piece 22. Accordingly, at the time of contact between the contacts, the first movable contact 23 comes into contact with the first fixed contact 26 prior to contact between the second movable contact 24 and the second fixed contact 27. At the time of separation between the contacts, the first movable contact 23 separates from the first fixed contact 26 after separation of the second movable contact 24 from the second fixed contact 27. Accordingly, an electric load produced at the time of contact between the contacts or separation between the contacts is chiefly applied to the first movable contact 23.

The first movable contact 23 and the second movable contact 24 are separated from each other in the lengthwise direction of the contact piece 22. More specifically, the first movable contact 23 is located at the leading end side of the contact piece 22 with respect to the second movable contact 24. The number of the movable contacts is not limited to two, but may be a number larger than two. Alternatively, only the single movable contact may be provided.

The contact piece 22 is connected to the proximal end portion 32 of the first terminal 21. The contact piece 22 has a plate shape elongated in the lengthwise direction of the first terminal 21. The contact piece 22 has a proximal end portion 33 and a leading end portion 34. The proximal end portion 33 of the contact piece 22 is joined to the first terminal 21. The leading end portion 34 of the contact piece 22 is a free end located on the side opposite to the proximal end portion 33. Accordingly, the proximal end portion 33 of the contact piece 22 is supported on the first terminal 21 in a cantilevered manner.

As illustrated in FIG. 5, the contact piece 22 includes a first plate 35 and a second plate 36. The contact piece 22 includes a slit 37 formed between the first plate 35 and the second plate 36. The slit 37 divides the first plate 35 and the second plate 36 from one another. The slit 37 extends lengthwise from the leading end portion 34 of the contact piece 22 toward the proximal end portion 33. The slit 37 does not reach the proximal end portion 33, and therefore the first plate 35 and the second plate 36 are connected with each other on the proximal end side of the slit 37. The first movable contact 23 is attached to the first plate 35. The second movable contact 24 is attached to the second plate 36. The first plate 35 includes a slit 38. The slit 38 is disposed between the first movable contact 23 and a portion connected with the first terminal 21. The first plate 35 has a width larger than a width of the second plate 36. A leading end of the first plate 35 is located on the leading end side of the first terminal 21 with respect to a leading end of the second plate 36.

The contact piece 22 includes an expanded portion 39. The expanded portion 39 has a curved shape protruding in a direction away from the first terminal 21. The expanded portion 39 projects from the movable contacts 23 and 24 toward the fixed contacts 26 and 27. The expanded portion 39 extends in the widthwise direction of the contact piece 22. The expanded portion 39 is located between the proximal end portion 33 of the contact piece 22 and the movable contacts 23 and 24 in the lengthwise direction of the contact piece 22.

As illustrated in FIG. 7, the contact piece unit 7 includes a plurality of leaf springs 41 to 43. The plurality of leaf springs 41 to 43 are laminated on each other. More specifically, the contact piece unit 7 includes the first leaf spring 41, the second leaf spring 42, and the third leaf spring 43. In the plurality of leaf springs 41 to 43, the first leaf spring 41 is disposed at a position farthest from the first terminal 21. In the plurality of leaf springs 41 to 43, the second leaf spring 42 is disposed at a position closest to the first terminal 21. The third leaf spring 43 is disposed between the first leaf spring 41 and the second leaf spring 42.

The number of the leaf springs is not limited to three, but may be a number smaller than three. Alternatively, the number of the leaf springs may be a number larger than three.

The first leaf spring 41 includes connection holes 411. The second leaf spring 42 includes connection holes 421. The third leaf spring 43 includes connection holes 431. The first terminal 21 includes connection projections 211. The connection projections 211 are inserted into the connection holes 411, 421, and 431 of the first to third leaf springs 41 to 43 to connect the first to third leaf springs 41 to 43 and the first terminal 21 integrally.

The first leaf spring 41 includes a first plate 351 and a second plate 361. The second leaf spring 42 includes a first plate 352 and a second plate 362. The third leaf spring 43 includes a first plate 353 and a second plate 363. The plurality of first plates 351 to 353 are laminated on each other, and constitute the first plate 35 of the contact piece 22 described above. The plurality of second plates 361 to 363 are laminated on each other, and constitute the second plate 36 of the contact piece 22 described above.

The first leaf spring 41, the second leaf spring 42, and the third leaf spring 43 include first contact attaching portions 441, 442, and 443, respectively. The first contact attaching portions 441 to 443 are attachment holes formed in the first to third leaf springs 41 to 43, respectively, and are so disposed as to overlap with each other. The first movable contact 23 is attached to the first contact attaching portions 441 to 443.

The first leaf spring 41, the second leaf spring 42, and the third leaf spring 43 include second contact attaching portions 451, 452, and 453, respectively. The second contact attaching portions 451 to 453 are attachment holes formed in the first to third leaf springs 41 to 43, respectively, and are so disposed as to overlap with each other. The second movable contact 24 is attached to the second contact attaching portions 451 to 453.

The first leaf spring 41 includes a first slit 461. The first slit 461 is formed around the first contact attaching portion 441. The first slit 461 has a shape curved along a part of the first contact attaching portion 441. The second leaf spring 42 includes a second slit 462. The second slit 462 is formed around the first contact attaching portion 442. The second slit 462 has a shape curved along a part of the first contact attaching portion 442. The third leaf spring 43 includes a third slit 463. The third slit 463 has a shape similar to the shape of the first slit 461.

The first leaf spring 41, the second leaf spring 42, and the third leaf spring 43 include slits 371 to 373, respectively. The slits 371 to 373 are so disposed as to overlap with each other, and constitute the slit 37 described above. The first leaf spring 41, the second leaf spring 42, and the third leaf spring 43 include slits 381 to 383, respectively. The slits 381 to 383 are so disposed as to overlap with each other, and constitute the slit 38 described above.

The first leaf spring 41, the second leaf spring 42, and the third leaf spring 43 include expanded portions 391 to 393, respectively. The expanded portions 391 to 393 are so disposed as to overlap with each other, and constitute the expanded portion 39 described above.

The first leaf spring 41 includes a first contact portion 412 and a second contact portion 413. The first contact portion 412 is provided at a leading end portion of the first plate 351. The second contact portion 413 is provided at a leading end portion of the second plate 361. The link member 6 presses the first contact portion 412 and the second contact portion 413 to move the movable contacts 23 and 24 in directions away from the fixed contacts 26 and 27 and thereby separate the movable contacts 23 and 24 from the fixed contacts 26 and 27. As a result, the set state of the relay 1 is switched to the reset state.

The second leaf spring 42 includes a first contact portion 422 and a second contact portion 423. The first contact portion 422 is provided at a leading end portion of the first plate 352. The second contact portion 423 is provided at a leading end portion of the second plate 362. The link member 6 presses the first contact portion 422 and the second contact portion 423 to move the movable contacts 23 and 24 toward the fixed contacts 26 and 27 and thereby bring the movable contacts 23 and 24 into contact with the fixed contacts 26 and 27. As a result, the reset state of the relay 1 is switched to the set state.

A leading end portion of the second leaf spring 42 is bent toward the first terminal 21. This configuration stabilizes a contact pressure of the contacts in the set state of the relay 1.

A rib 432 is provided on the third leaf spring 43. The rib 432 disposed at an edge of the second plate 363 of the third leaf spring 43 extends in the lengthwise direction of the contact piece 22. The rib 432 has a shape bent toward the first terminal 21.

Figure 10:
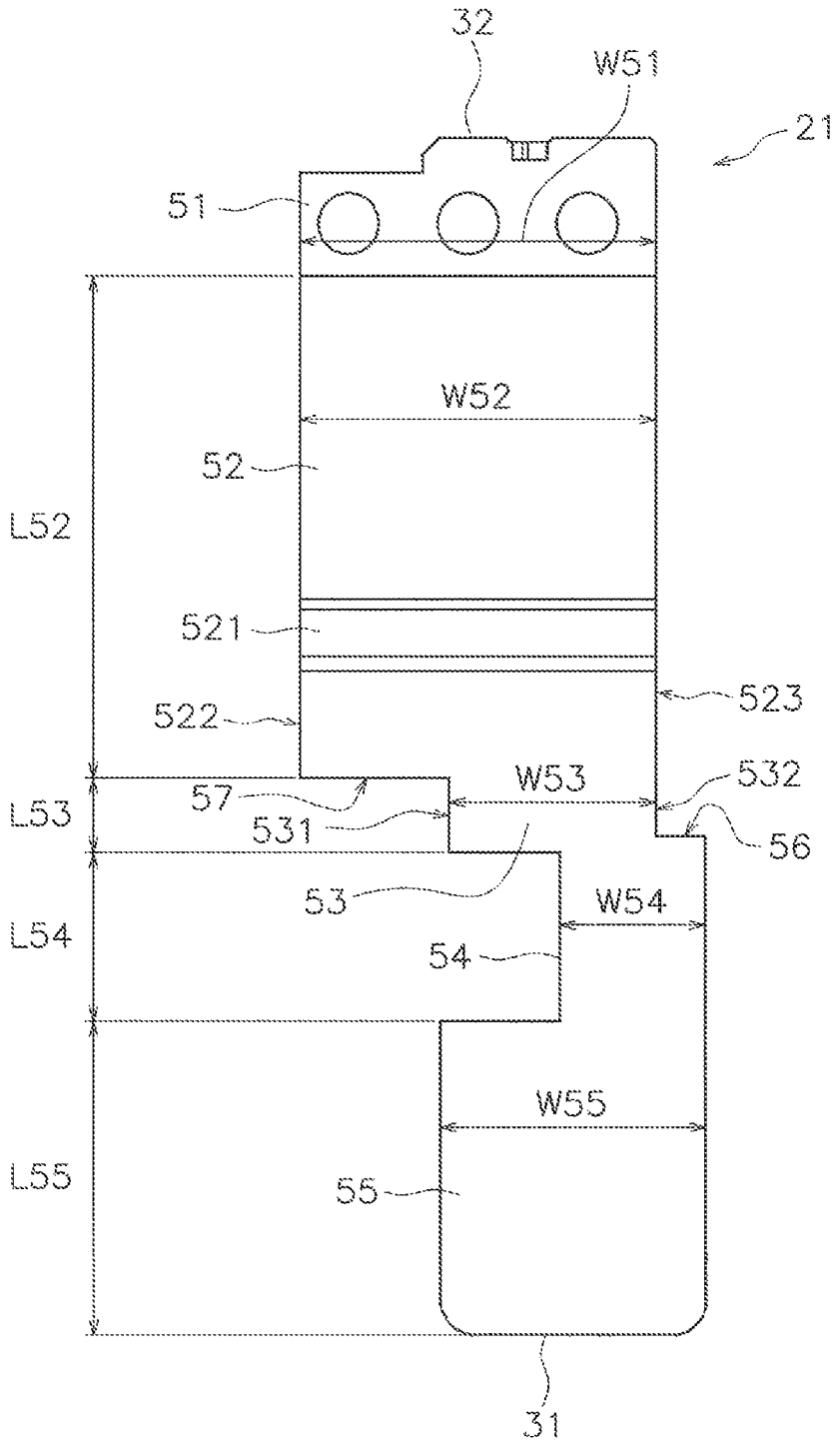
FIG. 10 is a side view of a first terminal.
Figure 11:
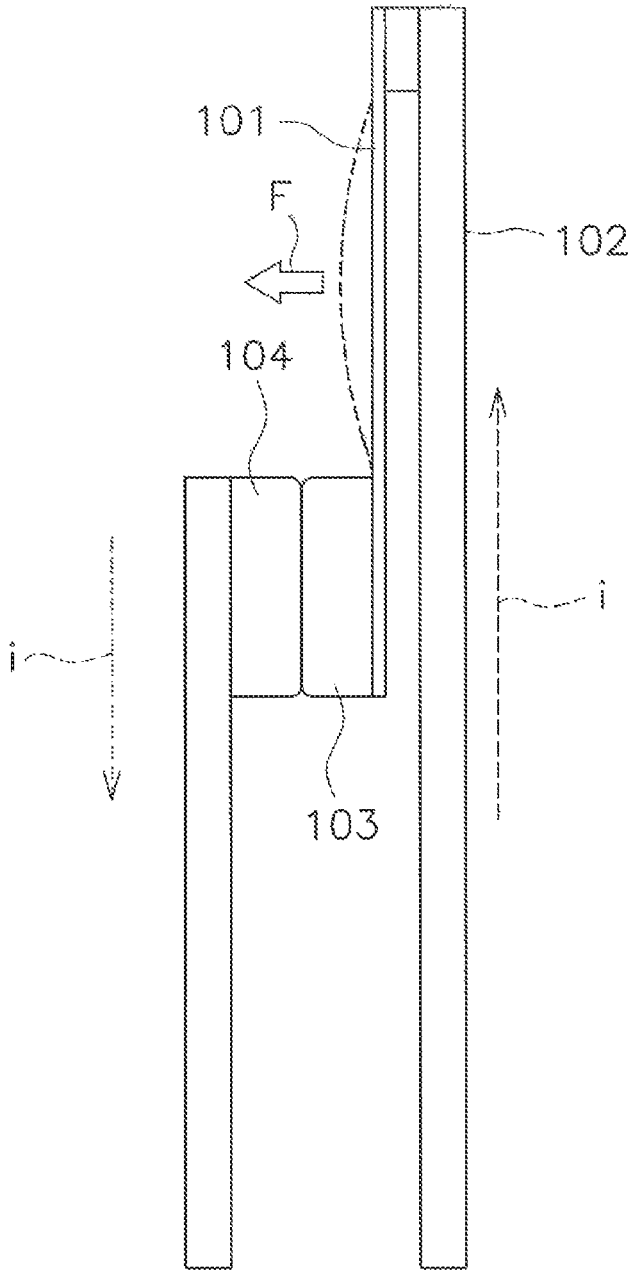
FIG. 11 is an explanatory view of electromagnetic repulsion force acting on a contact piece.

The first terminal 21 is now detailed. FIG. 10 is a side view of the first terminal 21. As illustrated in FIG. 10, the first terminal 21 includes a connection portion 51, a body 52, a narrow portion 53, a recess 54, and a distal end portion 55. The connection portion 51 includes the proximal end portion 32 of the first terminal 21. As illustrated in FIG. 9, the connection projections 211 described above are provided on the connection portion 51. The proximal end portion 33 of the contact piece 22 is connected with the connection portion 51.

The body 52 extends in the lengthwise direction of the contact piece 22 from the connection portion 51. A width W52 of the body 52 is equivalent to a width W51 of the connection portion 51. As illustrated in FIGS. 4 to 6, the body 52 faces the expanded portion 39 of the contact piece 22. The body 52 faces the second contact attaching portions 451 to 453. The body 52 includes a bent portion 521 having a bent shape. A proximal end side of the body 52 with respect to the bent portion 521 is inclined toward the contact piece 22 with nearness to the proximal end portion 32.

As illustrated in FIG. 10, the narrow portion 53 is located on a leading end side of the body 52. The narrow portion 53 is located between the body 52 and the recess 54 in the lengthwise direction of the first terminal 21. One edge 531 of the narrow portion 53 in the widthwise direction of the first terminal 21 is recessed widthwise from an edge 522 of the body 52. Accordingly, a step 57 is formed by the edge 531 of the first terminal 21 and the edge 522 of the body 52. An edge 532 that is the other edge of the narrow portion 53 in the widthwise direction of the first terminal 21 is continuously formed from an edge 523 of the body 52 and arranged in a line in the lengthwise direction.

The narrow portion 53 has a width W53 smaller than the width W52 of the body 52. The width W53 of the narrow portion 53 is smaller than a width W55 of the distal end portion 55. The width W53 of the narrow portion 53 is larger than a width W54 of the first terminal 21 at a portion including the recess 54. The width W53 of the narrow portion 53 is smaller than a width of the contact piece 22. The width W53 of the narrow portion 53 is larger than a width of the second plate 36. The width W53 of the narrow portion 53 is substantially equivalent to the width of the first plate 35. Alternatively, the width W53 of the narrow portion 53 may be larger than the width of the first plate 35.

As illustrated in FIG. 9, the narrow portion 53 overlaps with the first movable contact 23 as viewed in a direction perpendicular to a surface of the narrow portion 53. As illustrated in FIG. 8, the narrow portion 53 overlaps with a portion of the contact piece 22 located on a side where the connection portion 51 is disposed with respect to the first contact attaching portion 442 as viewed in the direction perpendicular to the surface of the narrow portion 53. The narrow portion 53 overlaps with the first plate 35 as viewed in the direction perpendicular to the surface of the narrow portion 53. The narrow portion 53 does not overlap with the second plate 36 as viewed in the direction perpendicular to the surface of the narrow portion 53. The narrow portion 53 overlaps with the second slit 462 as viewed in the direction perpendicular to the surface of the narrow portion 53.

As illustrated in FIG. 10, a length L53 of the narrow portion 53 is smaller than a length L52 of the body 52 in the lengthwise direction of the first terminal 21. The length L53 of the narrow portion 53 is smaller than a length L54 of the recess 54 in the lengthwise direction of the first terminal 21. The length L53 of the narrow portion 53 is smaller than a length L55 of the distal end portion 55 in the lengthwise direction of the first terminal 21. The length L53 of the narrow portion 53 is smaller than a dimension, i.e., a diameter of the first movable contact 23 in the lengthwise direction of the first terminal 21. The length L53 of the narrow portion 53 is larger than a diameter of the first contact attaching portion 442 in the lengthwise direction of the first terminal 21.

The recess 54 is recessed widthwise from the edge 531 of the narrow portion 53. The recess 54 overlaps with a portion of the contact piece 22 on the leading end side with respect to the first movable contact 23. The first terminal 21 includes a projection 56 located on the side opposite to the recess 54 in the widthwise direction of the first terminal 21. The projection 56 projects widthwise from the edge 532 of the narrow portion 53.

The distal end portion 55 is located on a leading end side of the recess 54. The distal end portion 55 includes the leading end portion 31 of the first terminal 21. The distal end portion 55 is a portion of the first terminal 21, which projects from the base 2 to the outside.

In the contact piece unit 7 according to the embodiment described above, the width W53 of the narrow portion 53 is smaller than the width W52 of the body 52, and smaller than the width of the contact piece 22. In this case, the current density can be increased in the narrow portion 53. Accordingly, assisting force produced by electromagnetic repulsion force for assisting the movable contacts 23 and 24 can be improved. Moreover, the width of the first terminal 21 is partially reduced at the narrow portion 53. Accordingly, a temperature rise of the first terminal 21 can be suppressed, compared to the case that the entire width of the first terminal 21 is reduced.

The narrow portion 53 overlaps with the first movable contact 23 as viewed in the direction perpendicular to the surface of the narrow portion 53. Accordingly, electromagnetic repulsion force generated in the narrow portion 53 can effectively act on the first movable contact 23 as assisting force.

The narrow portion 53 overlaps with the portion of the contact piece 22 on the side where the connection portion 51 is disposed with respect to the first contact attaching portions 441 to 443, as viewed in the direction perpendicular to the surface of the narrow portion 53. Thus, large electromagnetic repulsion force is generated in the portion of the contact piece 22 on the side where the connection portion 51 is disposed with respect to the first contact attaching portion 442, so that assisting force can be improved.

The recess 54 formed in the first terminal 21 overlaps with the portion of the contact piece 22 on the leading end side with respect to the first movable contact 23. Accordingly, the link member 6 is allowed to be positioned via the recess 54 and connected with the leading end portion 34 of the contact piece 22.

The length L53 of the narrow portion 53 is smaller than the length L54 of the recess 54 in the lengthwise direction of the first terminal 21. Accordingly, a temperature rise of the first terminal 21 can be suppressed, compared to the case that the narrow portion 53 is excessively long.

The first terminal 21 includes the projection 56 on the side opposite to the recess 54. In this case, a large width of the first terminal 21 can be secured in the portion including the recess 54. Accordingly, a temperature rise of the first terminal 21 can be suppressed.

The narrow portion 53 overlaps with the first plate 35 as viewed in the direction perpendicular to the surface of the narrow portion 53. Accordingly, electromagnetic repulsion force generated in the narrow portion 53 can effectively act on the first movable contact 23 as assisting force. Accordingly, contact stability of the contacts can be improved.

The narrow portion 53 does not overlap with the second plate 36 as viewed in the direction perpendicular to the surface of the narrow portion 53. In this case, the width W53 of the narrow portion 53 can be reduced as compared to the case that the narrow portion 53 overlaps with the second plate 36. Accordingly, the assisting force can be improved. The width W53 of the narrow portion 53 is equal to or larger than the width of the first plate 35. Accordingly, electromagnetic repulsion force generated in the narrow portion 53 can effectively act on the first movable contact 23 as assisting force. Accordingly, contact stability of the contacts can be improved.

The length L53 of the narrow portion 53 is smaller than the diameter of the first movable contact 23 in the lengthwise direction of the terminal. In this case, a temperature rise of the first terminal 21 can be suppressed, compared to the case that the narrow portion 53 is excessively long.

The present invention is not limited to the embodiment described herein as a specific embodiment of the present invention. Various modifications may be made without departing from the scope of the subject matters of the invention.

The shape of the first terminal 21 may be modified from the shape described above in the embodiment. For example, the recess 54 may be eliminated depending on the structure of the link member 6. The width W53 or the length L53 of the narrow portion 53 may be changed from the width or the length described above in the embodiment. The position of the narrow portion 53 may be changed from the position described above in the embodiment.

The shape of the contact piece 22 may be modified from the shape described above in the embodiment. For example, the contact piece 22 divided into the first plate 35 and the second plate 36 in the embodiment may be provided as one piece component. The positions of the first movable contact 23 and the second movable contact 24 shifted lengthwise in the embodiment may be aligned in a line.

Configurations of the relay 1 other than the contact piece unit 7 may be modified from the corresponding configurations described above in the embodiment.

INDUSTRIAL APPLICABILITY

According to the present invention, a contact piece unit and a relay capable of improving assisting force produced by electromagnetic repulsion force for assisting a contact while suppressing a temperature rise of a terminal.

DESCRIPTION OF SYMBOLS

21 first terminal
22 contact piece
23, 24 movable contact
51 connection portion
52 body
53 narrow portion
7 contact piece unit
442 first contact attaching portion
54 recess
56 projection
23 first movable contact
24 second movable contact
35 first plate
36 second plate

The invention claimed is:

1. A contact piece unit comprising:
a terminal;
a contact piece connected with the terminal, and disposed at a position facing the terminal; and
a contact attached to the contact piece, wherein
the terminal includes
a connection portion connected with the contact piece,
a body that extends in a lengthwise direction of the contact piece from the connection portion, and
a narrow portion that has a width smaller than a width of the body, and smaller than a width of the contact piece, wherein the narrow portion overlaps with the contact as viewed in a direction perpendicular to a surface of the narrow portion.

2. The contact piece unit according to claim 1, wherein the contact comprises:
a first contact, and
a second contact, a height of the second contact from the contact piece being smaller than a height of the first contact from the contact piece,
the contact piece comprises
a first plate to which the first contact is attached, and
a second plate divided from the first plate by a slit that extends in the lengthwise direction of the contact piece, the second contact being attached to the second plate, and
the narrow portion overlaps with the first plate as viewed in the direction perpendicular to the surface of the narrow portion.

3. The contact piece unit according to claim 2, wherein the narrow portion does not overlap with the second plate as viewed in the direction perpendicular to the surface of the narrow portion.

4. The contact piece unit according to claim 2, wherein a width of the narrow portion is equal to or larger than a width of the first plate.

5. The contact piece unit according to claim 2, wherein a length of the narrow portion is smaller than a dimension of the first contact in the lengthwise direction of the terminal.

6. A relay comprising the contact piece unit according to claim 1.

7. A contact piece unit comprising:
a terminal;
a contact piece connected with the terminal, and disposed at a position facing the terminal; and
a contact attached to the contact piece, wherein
the terminal includes
a connection portion connected with the contact piece,
a body that extends in a lengthwise direction of the contact piece from the connection portion, and
a narrow portion that has a width smaller than a width of the body, and smaller than a width of the contact piece, wherein
the contact piece comprises a contact attaching portion to which the contact is attached, and
the narrow portion overlaps with a portion of the contact piece on a side where the connection portion is disposed with respect to the contact attaching portion as viewed in the direction perpendicular to the surface of the narrow portion.

8. A contact piece unit comprising:
a terminal;
a contact piece connected with the terminal, and disposed at a position facing the terminal; and
a contact attached to the contact piece, wherein
the terminal includes
a connection portion connected with the contact piece,
a body that extends in a lengthwise direction of the contact piece from the connection portion, and
a narrow portion that has a width smaller than a width of the body, and smaller than a width of the contact piece, wherein
the terminal comprises a recess recessed widthwise, and
the recess overlaps with a portion of the contact piece on a leading end side with respect to the contact.

9. The contact piece unit according to claim 8, wherein the narrow portion is located between the body and the recess in a lengthwise direction of the terminal.

10. The contact piece unit according to claim 8, wherein a length of the narrow portion is smaller than a length of the recess in the lengthwise direction of the terminal.

11. The contact piece unit according to claim 8, wherein the terminal further includes a projection that projects widthwise on a side opposite to the recess.

* * * * *